United States Patent [19]

Ishikawa et al.

[11] Patent Number: 5,067,424

[45] Date of Patent: Nov. 26, 1991

[54] APPARATUS FOR SEWING FABRIC PIECES TO SLIDE FASTENER CHAIN

[75] Inventors: Kiichirou Ishikawa; Chet Dudek, both of Marietta; James Hutcherson, Kennesaw, all of Ga.

[73] Assignee: Yoshida Kogyo K.K., Tokyo, Japan

[21] Appl. No.: 578,750

[22] Filed: Sep. 7, 1990

[51] Int. Cl.[5] ..... D05B 3/12; D05B 23/00

[52] U.S. Cl. ..... 112/307; 112/104; 112/113; 112/121.27

[58] Field of Search ..... 112/104, 113, 265.2, 112/121.27, 318, 322, 305, 307

[56] References Cited

U.S. PATENT DOCUMENTS

| | | | |
|---|---|---|---|
| 3,570,104 | 3/1971 | Jenson . | |
| 3,633,528 | 1/1972 | Frohlich et al. | 112/265.2 |
| 3,685,474 | 8/1972 | Frohlich et al. | 112/265.2 |
| 4,236,292 | 12/1980 | Orr et al. . | |
| 4,333,232 | 6/1982 | Orr et al. . | |
| 4,362,116 | 12/1982 | Sen Gupta et al. . | |
| 4,441,438 | 4/1984. | Takahashi | 112/121.27 X |
| 4,541,352 | 9/1985 | Boser et al. . | |
| 4,562,782 | 1/1986 | Doucette et al. | 112/121.27 X |
| 4,576,104 | 3/1986 | Miyakawa . | |
| 4,594,925 | 6/1986 | Ishikawa . | |
| 4,608,745 | 9/1986 | Miyakawa et al. . | |
| 4,611,546 | 9/1986 | Miyakawa et al. . | |
| 4,638,557 | 1/1987 | Sen Gupta et al. . | |
| 4,644,886 | 2/1987 | Miyakawa . | |
| 4,660,821 | 4/1987 | Boser et al. . | |
| 4,979,450 | 12/1990 | Dudek et al. | 112/265.2 |

*Primary Examiner*—Werner H. Schroeder
*Assistant Examiner*—Paul C. Lewis
*Attorney, Agent, or Firm*—Hill, Van Stanten, Steadman & Simps

[57] ABSTRACT

An apparatus for automatically sewing a succession of fabric pieces to a continuous slide fastener chain comprises a sewing machine for feeding and sewing the fabric pieces and slide fastener chain together; a guiding apparatus disposed upstream of the sewing machine and including a pair of opposed guide rollers urged towards each other with the slide fastener chain interposed therebetween so as to be driven via the slide fastener chain by the sewing machine while guiding the slide fastener chain towards the sewing machine; and a feeding apparatus disposed between the guiding apparatus and the sewing machine and including a pair of opposed feed rollers urged towards each other so as to convergently place therebetween the slide fastener chain into superimposed relation to the fabric pieces and to feed the fabric pieces with the slide fastener chain thus superimposed thereon to the sewing machine. One feed roller of the two feed rollers of the feeding apparatus which the fabric pieces ride on and one guide roller of the guide rollers of guiding apparatus are so linked as to rotate with each other.

6 Claims, 1 Drawing Sheet

APPARATUS FOR SEWING FABRIC PIECES TO SLIDE FASTENER CHAIN

BACKGROUND OF THE INVENTION

1. Field of the Invention:

The present invention generally relates to the production of closures for openings and more particularly to an apparatus for sewing a succession of fabric pieces such as flypieces for trousers, panels of a one-piece dress or gores of a skirt to a continuous length of slide fastener chain.

2. Description of the prior art:

A typical apparatus for sewing a succession of flypieces to a continuous slide fastener chain is disclosed in U.S. Pat. No. 4,576,104 and U.S. Pat. No. 4,644,886. In these conventional apparatuses, a succession of flypieces are fed one after another horizontally along a guide table through feed rollers to an intermittently-operating sewing machine, while a continuous slide fastener chain is fed continuously to the sewing machine independent from the feeding of flypieces. The flypieces are then sewn to the continuous slide fastener chain by the sewing machine.

These conventional apparatuses suffer from the following drawbacks. The flypieces and the continuous slide fastener chain are fed independently from each other towards the sewing machine. Furthermore, the slide fastener chain is fed directly to beneath a presser foot and is forced thereby to overlap the flypiece, to thus press the flypiece against a support table, whereupon the flypiece is subjected to considerable frictional resistance. This is liable to preclude smooth and constant feeding of the flypieces. As a result, the flypieces may be sewn to the slide fastener chain at irregular intervals, thus forming an excessively wide unnecessary gap between a preceding flypiece and a succeeding flypiece. In the worst case, the sewing operation might stop.

SUMMARY OF THE INVENTION

With the foregoing difficulties in view, it is therefore an object of the present invention to provide an apparatus wherein a succession of fabric pieces and a continuous slide fastener chain are fed reliably to a sewing machine and the fabric pieces are sewn to the slide fastener chain accurately with adjacent fabric pieces disposed in exact end-to-end relation to each other.

According to the present invention, there is provided an apparatus for automatically sewing a succession of fabric pieces to a continuous slide fastener chain, the apparatus comprising a sewing machine for feeding and sewing the fabric pieces and slide fastener chain together; guiding means disposed upstream of the sewing machine and including a pair of opposed guide rollers urged towards each other with the slide fastener chain interposed therebetween so as to be driven via the slide fastener chain by the sewing machine while guiding the slide fastener chain towards the sewing machine; feeding means disposed between the guiding means and the sewing machine and including a pair of opposed feed rollers urged towards each other so as to convergently place therebetween the slide fastener chain into superimposed relation with the fabric pieces and to feed the fabric pieces with the slide fastener chain thus superimposed thereon to the sewing machine; and means for linking that feed roller out of the two feed rollers of the feeding means which the fabric pieces ride on and one guide roller of the guide rollers of guiding means so as to cause the feed roller and the guide roller to rotate with each other.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
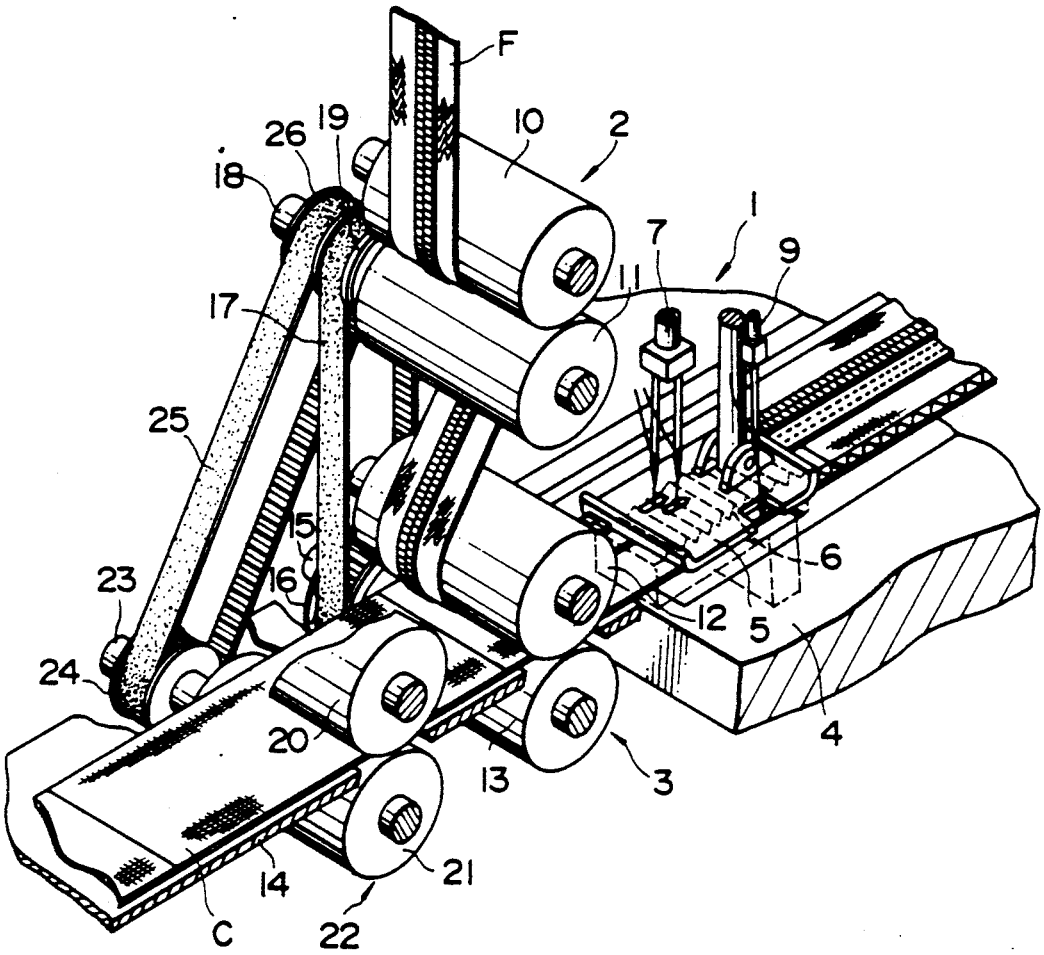
FIG. 1 is a perspective view, with parts broken away, of a sewing apparatus embodying the present invention.

As shown in FIG. 1, a sewing apparatus according to the present invention broadly comprises, from upstream to downstream, a supply table 14 constituting together with a coplanar sewing table 4 of a sewing machine 1 described hereinafter a horizontal feed path along which a succession of flypieces C are horizontally fed toward a sewing machine 1; guiding means 2 disposed above the horizontal feed path to guide the slide fastener chain F down to the sewing machine 1; feeding means 3 disposed below the guiding means 2 for placing the downwards-fed slide fastener chain F into superimposed relation with the horizontally-fed flypieces C and for feeding the flypiece-superimposed slide fastener chain F to the sewing machine 1; and the sewing machine 1 for sewing the flypieces C to the continuous slide fastener chain F in succession.

The sewing machine 1 may be of any conventional type which is put on the market. The sewing machine 1 comprises the sewing table 4 for carrying the flypieces C and the slide fastener chain F thereon during sewing; a presser foot 5 and a feed dog 6 coacting with each other to feed the slide fastener chain F and the flypiece C downstream; and a pair of sewing needles 7 for sewing the flypieces C to the slide fastener chain F in succession. Since the apparatus shown in FIG. 1 is designed for sewing flypieces C to the slide fastener chain F especially on trousers, the apparatus also includes an additional needle 9 for effecting overedge or serge stitching 8 along one of the longitudinal edges of the flypieces C in order to prevent it from ravelling. However, this additional needle 9 does not constitute an indispensable part of the present invention.

The guide means 2 comprises a pair of guide rollers 10, 11 which are rotatably mounted in vertically opposed relationship on a suitable bracket (not shown) which is in turn fixed to a frame (also not shown) of the apparatus. The slide fastener chain F is supplied from a spool (not shown) mounted above the apparatus to the guiding means 2. A guide roller 10 of the guide rollers 10, 11 is normally urged by suitable urging means against the other guide roller 11 with the fastener chain F clamped therebetween, so that an adequate tension is imparted to the continuous slide fastener chain F which is being fed to the sewing machine 1. As the slide fastener chain F is being drawn by the sewing machine 1, especially the feed dog 6 thereof during sewing operation, the opposed rollers 10, 11 are driven or rotated by the thus advancing slide fastener chain F clamped therebetween. Note that in more pricise terms, "rotate" as used here means "to rotate intermittently" since the slide fastener chain F must stop whenever the needles 7 vertically move through the slide fastener chain F and the flypieces C for sewing. However, it will be called only "rotate" for brevity hereinafter.

Figure 2:
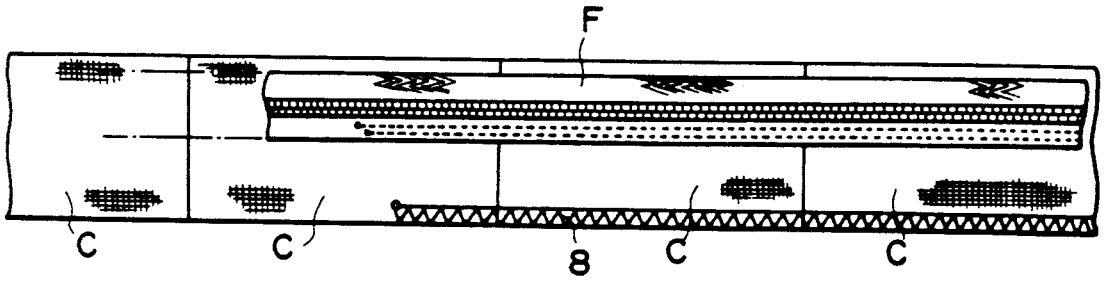
FIG. 2 is a fragmentary plan view of a succession of the flypieces being sewn to a continuous slide fastener chain.

As shown in FIG. 1, the feeding means 3 comprises a pair of vertically opposed feed rollers 12, 13 disposed on the horizontal feed path immediately before the sewing machine 1 and below the guiding means 2. The slide fastener chain F fed downwards from the guiding means 2 and the flypieces C fed horizontally along the supply table 14 are convergently guided between the opposed feed rollers 12, 13 so as to place the slide fastener chain F into superimposed relation with the flypieces C and subsequently to feed the flypiece-superimposed slide fastener chain F to the sewing machine 1. Feed roller 12 of the two feed rollers 12, 13 which the slide fastener chain F rides on is normally urged by suitable urging means (not shown) against the other feed roller 13 with the slide fastener chain F and the flypieces C resiliently clamped therebetween, so that an adequate tension is imparted to the slide fastener chain F and the flypieces C which are being fed to the sewing machine 1. The feed roller 13 which the flypieces C ride on has its axle 15 provided on its one end with a grooved pulley 16. Guide roller 11 of the guide rollers 11, 12 also has its axle 18 provided on its one end with a grooved pulley 19. An endless timing belt 17 extends around and between the grooved pulley 16 and the grooved pulley 19 so that the rotation of the roller 11 is transmitted to the roller 13 via the timing belt 17. This means that the feed roller 13 of the feeding means 3 on which the flypieces C ride and the guide roller 11 of the guiding means 2 are rotated with each other, so that the continuous slide fastener chain F and flypieces C can be reliably fed in superimposed relation to the sewing machine 1 and the flypieces C can be sewn to the slide fastener chain F accurately with adjacent flypieces C disposed in exact end-to-end relation to each other, as clearly shown in FIG. 2. The apparatus according to the present invention may also include supplying means 22 disposed immediately before the feeding means 3. The supplying means 22 comprises a pair of vertically opposed rollers 20, 21 and is adapted to feed a succession of flypieces C one after another to the feeding means 3. The upper supply roller 20 is normally urged by suitable urging means (not shown) against the other supply roller 21 with the flypieces C resiliently clamped therebetween, so that an adequate tension is imparted to the flypieces C which are being fed to the sewing machine 1. The supply roller 21 has its axle 23 provided integrally with a grooved pulley 24. In addition to the pulley 19, the guide roller 11 of the guiding means 2 has an additional grooved pulley 26 provided on its axle 18. Another timing belt 25 extends around and between the grooved pulley 24 and the grooved pulley 26, so that the rotation of the guide roller 11 is transmitted to the supply roller 21 via the timing belt 25. As a result, the guide rollers 10, 11 of the guiding means 2 and the supply rollers 20, 21 of the supplying means 22 and the feed rollers 12, 13 of the feeding means 3 are all rotated with one another, so that the flypieces C can be fed smoothly and accurately with adjacent flypieces C disposed in exact end-to-end relation to each other, although sliding movement of the flypieces C on the supply table 14 causes frictional resistance which would otherwise prevent the smooth and accurate feeding of the flypieces C.

In the embodiment shown in FIG. 1, the timing belt 25 extends around and between the grooved pulley 24 of the supply roller 21 of the supplying means 22 and the grooved pulley 26 of the guide roller 11 of the guiding means 2. But, alternatively, the timing belt 25 may extend around and between the grooved pulley 24 of the supply roller 21 of the supplying means 22 and an additional grooved pulley (not shown) provided on the axle 15 on the outer side of the grooved pulley 16. As in the preceding embodiment, the guide rollers 10, 11 of the guiding means 2 and the supply rollers 20, 21 of the supplying means 22 and the feed rollers 12, 13 of the feeding means 3 are likewise rotated with one another, so that the flypieces C can be fed accurately with adjacent flypieces disposed in exact end-to-end relation to each other, although sliding the flypieces C on the supply table 14 causes frictional resistance.

The feeding rate is likely to vary according to variety, materials and thickness of the flypieces C to be sewn to the slide fastener chain F or other factors, so that the adjacent flypieces C could fail to assume exact end-to-end relation to each other. In order to rectify the variance of the feeding rate, the rates of rotations of the respective rollers 10, 11; 12, 13; and 20, 21 of the guiding means 2, the feeding means 3 and the supplying means 22 must be adjusted. For this purpose, grooved pulleys and timing belts of various sizes and lengths may be ready for replacement. Alternatively, a transmission may be provided somewhere on the apparatus for the same purpose.

In the embodiments set forth hereinabove, the pairs of rollers are linked with each other through grooved pulleys and timing belts. Alternatively, sprockets and endless chains may be conveniently substituted therefor.

It is to be acknowledged that the supplying means 22 is not always necessary since the flypieces C may be supplied manually into the feeding means 3 provided immediately before the sewing machine 1.

Turning now to the operation of the apparatus according to the present invention. A succession of flypieces C are fed horizontally between the opposed supply rollers 20, 21 of the supplying means 22, between the opposed feed rollers 12, 13 of the feeding means 3 and then between the presser foot 5 and the feed dog 6 of the sewing machine 1.

Concurrently, a continuous slide fastener chain F is drawn out of the spool (not shown) and is fed between the opposed guide rollers 10, 11 of the guiding means 2, and between the opposed feed rollers 12, 13 of the feeding means 3, whereby the slide fastener chain F is brought into superimposed relation to the flypieces C. And, the slide fastener chain F with the flypieces C is fed between the presser foot 5 and the feed dog 6. As the sewing machine 1 operates, the presser foot 5 and the feed dog 6 of the sewing machine 1 coact to feed the flypieces C with the slide fastener chain F superimposed thereon downstream; and at the same time the sewing needles 7 sew the flypieces C to the slide fastener chain F and the other needle 9 effects the overedge stitching 8 along one of the edges of the flypieces C. The feeding of the slide fastener chain F by the presser foot 5 and the feed dog 6 of the sewing machine 1 causes the opposed guide rollers 10, 11 to rotate, which rotation is, partly, transmitted via the timing belt 17 to the opposed feed rollers 12, 13 of the feeding means 3 and is also transmitted via the timing belt 25 to the opposed supply rollers 20, 21 of the supplying means 22, so that the opposed guide rollers 10, 11, the opposed feed rollers 12, 13 and the opposed supply rollers 20, 21 all rotate with one another. As a result, the flypieces C and the slide fastener chain F superimposed thereon are fed reliably to the sewing machine 1; in such a manner that, while a preceding flypiece C with the slide fastener chain F superimposed thereon is fed to the sewing machine 1 and sewn to the slide fastener chain F thereby, an ensuing flypiece C is led to the supplying means 22 with its leading end disposed exactly contiguous to the tailing end of the preceding flypiece C. This operation is automatically repeated on a succession of the flypieces C and the continuous slide fastener chain F, thus providing the slide fastener chain F with a multiplicity of the flypieces C sewn thereto in succession.

As set forth earlier, the feed roller 13 of the feeding means 3 on which the flypieces C ride and the guide roller 11 of the guiding means 2 are so linked as to rotate with each other, so that, advantageously, the continuous slide fastener chain F and flypieces C can be reliably fed to the sewing machine 1 and the flypieces C can be sewn to the slide fastener chain F accurately and automatically.

Although the foregoing description about the construction and operation of the apparatus according to the present invention deals with sewing of a succession of the flypieces C for trousers to the continuous slide fastener chain F, this apparatus is not limited to sewing of flypieces F. This apparatus can be employed for sewing a succession of any fabric pieces such as panels of one-piece dress or gores of a skirt to the continuous slide fastener chain F, of course.

Obviously, various modifications and variations of the present invention are possible in light of the above teaching. It is therefore to be understood that within the scope of the appended claims the invention may be practiced otherwise than as specifically described.

What is claimed is:

1. An apparatus for automatically sewing a succession of fabric pieces to a continuous slide fastener chain, with adjacent fabric pieces disposed in end-to-end relation to each other, the apparatus comprising a sewing machine for feeding and sewing the fabric pieces and slide fastener chain together; guiding means disposed upstream of the sewing machine and including a pair of opposed guide rollers urged towards each other with the slide fastener chain interposed therebetween so as to be driven via the slide fastener chain by the sewing-machine while guiding the slide fastener chain towards the sewing machine; feeding means disposed between the guiding means and the sewing machine and including a pair of opposed feed rollers urged towards each other so as to convergently place therebetween the slide fastener chain into superimposed relation with the fabric pieces and to feed the fabric pieces with the slide fastener chain thus superimposed thereon to the sewing machine; and means for linking one feed roller of the pair of feed rollers of the feeding means and one guide roller of the pair of guide rollers of the guiding means so as to cause said one feed roller and said one guide roller to rotate with each other.

2. An apparatus according to claim 1, wherein said one feed roller comprises a first axle and said one guide roller comprises a second axle, the means for linking comprising a first pulley provided on the first axle of the one feed roller, a second pulley provided on the second axle of the one guide roller and an endless timing belt extending between and around the first and second pulleys.

3. An apparatus according to claim 1, wherein said one feed roller comprises a first axle, and said one guide roller comprises a second axle, the means for linking comprising a first sprocket provided on the first axle of the one feed roller, a second sprocket provided on the second axle of the one guide roller and an endless chain extending between and around the first and second sprockets.

4. An apparatus for automatically sewing a succession of fabric pieces to a continuous slide fastener chain, the apparatus comprising:

a sewing machine for feeding and sewing the fabric pieces and slide fastener chain together;

guiding means disposed upstream of the sewing machine and including a pair of opposed guide rollers urged towards each other with the slide fastener chain interposed therebetween so as to be driven via the slide fastener chain by the sewing machine while guiding the slide fastener chain towards the sewing machine;

feeding means disposed between the guiding means and the sewing machine and including a pair of opposed feed rollers urged towards each other so as to convergently place therebetween the slide fastener chain into superimposed relation with the fabric pieces and to feed the fabric pieces with the slide fastener chain thus superimposed thereon to the sewing machine;

means for linking one feed roller of the pair of feed rollers of the feeding means and one guide roller of the pair of guide rollers of the guiding means so as to cause said one feed roller and said one guide roller to rotate with each other;

supplying means disposed upstream of the feeding means and including a pair of supply rollers urged towards each other to feed through therebetween the fabric pieces to the feeding means;

and an additional linking means for linking one supply roller of the pair of supply rollers of the supplying means and an individual guide roller of the pair of guide rollers of the guiding means so as to cause the one supply roller and the individual guide roller to rotate with each other.

5. An apparatus according to claim 4, wherein said one supply roller comprises a third axle, and said individual guide roller comprises an axle portion, the additional linking means comprising a third pulley provided on the third axle of the one supply roller, a fourth pulley provided on the axle portion of the individual guide roller and an endless timing belt extending between and around the third and fourth pulleys.

6. An apparatus according to claim 4, wherein said one supply roller comprises a third axle, and said individual guide roller comprises an axle portion, the additional linking means comprising a third sprocket provided on the third axle of the one supply roller, a fourth sprocket provided on the axle portion of the individual guide roller and an endless chain extending between and around the third and fourth sprockets.

* * * * *